US007025155B1

(12) United States Patent
Estes

(10) Patent No.: US 7,025,155 B1
(45) Date of Patent: Apr. 11, 2006

(54) ROCK BIT WITH CHANNEL STRUCTURE FOR RETAINING CUTTER SEGMENTS

(75) Inventor: Roy D. Estes, Weatherford, TX (US)

(73) Assignee: Rock Bit International, L.P., Fort Worth, TX (US)

( * ) Notice: Subject to any disclaimer, the term of this patent is extended or adjusted under 35 U.S.C. 154(b) by 12 days.

(21) Appl. No.: 10/419,589

(22) Filed: Apr. 21, 2003

(51) Int. Cl.
*E21B 10/16* (2006.01)

(52) U.S. Cl. ..... 175/413; 175/373; 175/432; 76/108.2

(58) Field of Classification Search ..... 175/373, 175/412, 413, 382, 325.4, 432, 426, 428, 175/315, 331, 377; 76/108.1, 108.2
See application file for complete search history.

(56) References Cited

U.S. PATENT DOCUMENTS

| | | | | |
|---|---|---|---|---|
| 1,143,275 | A * | 6/1915 | Hughes | 175/367 |
| 3,599,737 | A * | 8/1971 | Fischer | 175/324 |
| 3,981,370 | A * | 9/1976 | Bingham et al. | 175/373 |
| 4,838,366 | A * | 6/1989 | Jones | 175/426 |
| 5,421,423 | A * | 6/1995 | Huffstutler | 175/374 |
| 5,454,437 | A | 10/1995 | Estes | |
| 6,167,975 | B1 | 1/2001 | Estes | |
| 6,435,287 | B1 | 8/2002 | Estes | |
| 6,823,951 | B1 * | 11/2004 | Yong et al. | 175/331 |

* cited by examiner

*Primary Examiner*—Kenneth Thompson
(74) *Attorney, Agent, or Firm*—Storm LLP; John G. Fischer

(57) ABSTRACT

A roller cone body defines a circumferential channel or race into which a plurality of cutter or wear segments are mounted. The wear segments may be of any appropriate contour or shape, such as for example chisel, spherical, or even flat face and are preferably made or carbide. The wear elements may be all the same within a channel or race, or they may be varied within a race as needed for a particular application.

23 Claims, 9 Drawing Sheets

ROCK BIT WITH CHANNEL STRUCTURE FOR RETAINING CUTTER SEGMENTS

FIELD OF THE INVENTION

The present invention relates generally to the field of rock bits for boring into earth formations, and, more particularly, to a roller cone bit with tooth segments which mount to the cone.

BACKGROUND OF THE INVENTION

Roller cone bits are well known in the art for boring into earth formations. Such bits may have one or a plurality of cones, typically three, each of which rotates about its own axis as the bit body is rotated about its axis. Each cone has cutting elements on the exterior that gouge and scrape the borehole bottom. In known roller cone bits, cutting elements may generally classified as milled tooth, in which the cutting elements are formed from a solid workpiece, or insert type, which individual cutter inserts are press fit into mating holes formed in the cone of the bit body. In mining and tunnel boring operations, rolling cone cutters often have disk type cutting elements.

For harder formations, tungsten carbide inserts define teeth extending from the exterior surface of the cone. These inserts are press fit into mating holes in the cones. Each insert has a cylindrical base that fits with an interference fit into the cone body. A cutting tip, which may have various shapes, protrudes from the base of the insert.

As the drill bit is used to bore into an earth formation, the inserts are worn away until the bit must be extracted from the hole and a new bit inserted. Such bits typically last approximately 40 to 100 hours of drill time in a typical formation. The useful lifetime of the inserts, and therefore the bit, depends on a number of well known factors, including the hardness of the material from which the inserts are made, the hardness of the earth formation, the weight on bit, and other factors. In very abrasive formations the useful lifetime of the bit is often limited by the total amount of carbide material available for resisting wear, especially the amount of carbide in the gage cutting area, a factor which is not well appreciated in the art. Increasing the number of inserts has been tried as a solution to this limiting factor, but the inserts must be spaced apart by a minimum distance so that sufficient body material is left between inserts in order to provide adequate mechanical support for the inserts. Use of diamond enhanced inserts (DEI) has been another solution that is often used, but this is a very expensive solution.

Thus, there remains a need for a structure and a method of installing wear elements in a roller cone bit that increases the total amount of material available for resisting abrasion. The present invention is directed to this need in the art.

SUMMARY OF THE INVENTION

The present invention primarily comprises a roller cone body including a circumferential channel or race into which are mounted a plurality of wear elements, referred to herein as segments. The wear elements may be of any appropriate contour or shape, such as for example chisel, spherical, or even flat face. The wear elements may be all the same within a channel or race, or they may be varied within a race as needed for a particular application.

The cone body may have more than one such channel or race formed therein, and the cone may also or alternatively include mill tooth forms or inserts on other portions of the cone body.

A keyway is provided into which the segments are inserted into the channel for mounting upon the cone body. Once an appropriate number of segments have been inserted into the channel, a key is then inserted and secured in place, such as for example by pinning. If desired, the segments may then be soldered in place, or the segments may allowed to remain unsoldered. Each of the segments includes an enlarged section to fit within the channel, and to retain the segment on the cone body. The enlarged section may be subject to stress in some applications, and thus a stress relieve annulus is provided to eliminate the possibility of failure due to excess stress on the segments.

These and other features and advantages of this invention will be readily apparent to those skilled in the art.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

DETAILED DESCRIPTION OF PREFERRED EMBODIMENTS

Figure 1:
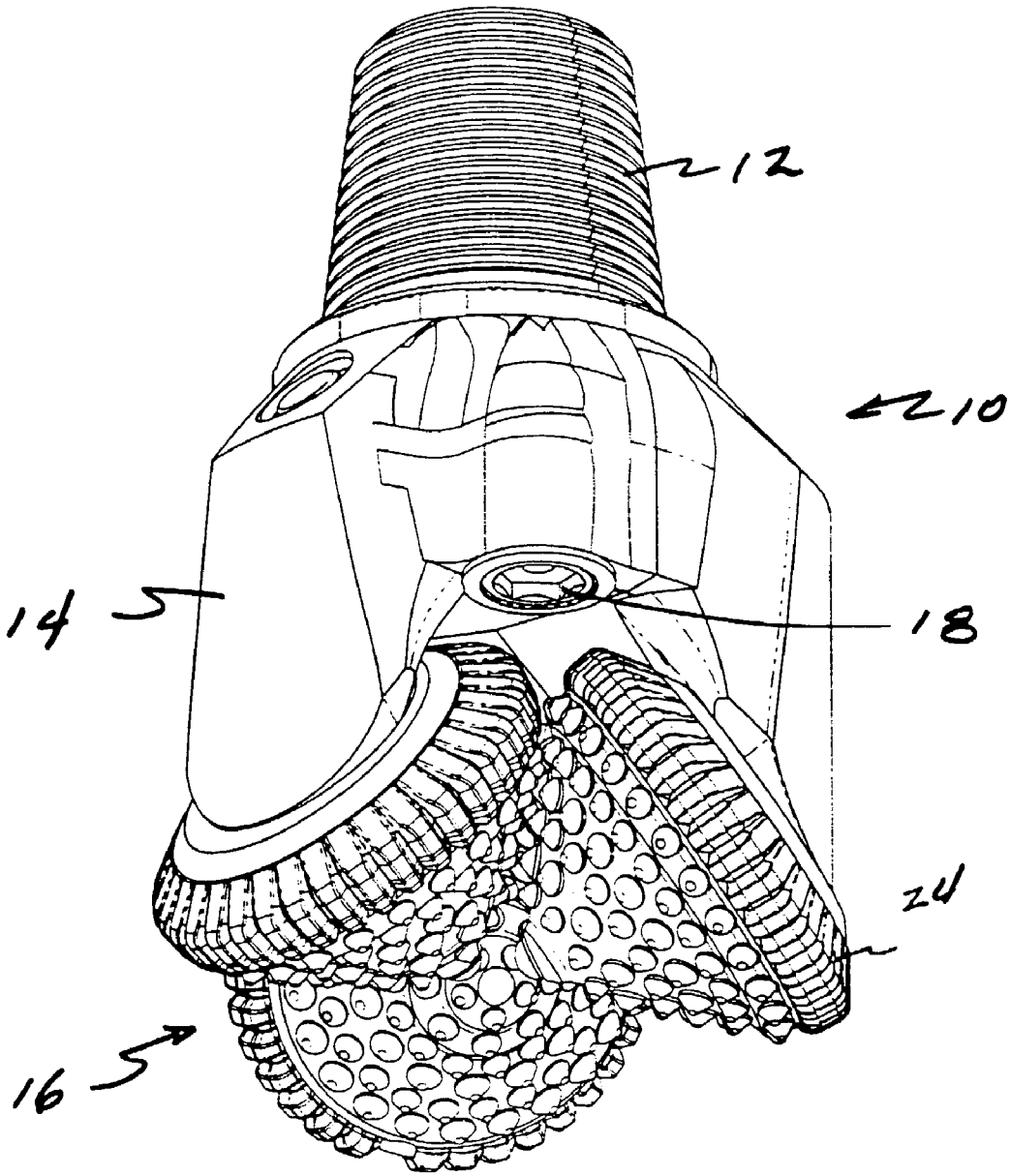
FIG. 1 is a perspective view of a tri-cone drill bit using the present invention.

FIG. 1 illustrates a tri-cone rotary drill bit 10 using the structure of the present invention. The bit 10 is used for illustrative purposes, although it is to be understood that the present invention may be employed on any rotary cone cutter, such as for example a one cone bit, a bi-center bit on which a rotary cone is used, and the like.

The drill bit 10 has a threaded section 12 on its upper end for threading to a drill string or mud motor (not shown) for rotation. The threaded section 12 extends into an elongate body 14 which, at its lower end, provides support for three rotary cone cutters 16, constructed in accordance with the present invention. The body 14 has fluid nozzles 18 for directing drilling fluid downward and toward the leading edge of the cone bit 16. The bit 10 includes other portions constructed as shown and described in my U.S. Pat. No. 6,167,975, incorporated herein by reference. The bit 10 further includes a gage row of cutter or wear segments 24, inserted into a race or channel, as further described below.

Figure 2:
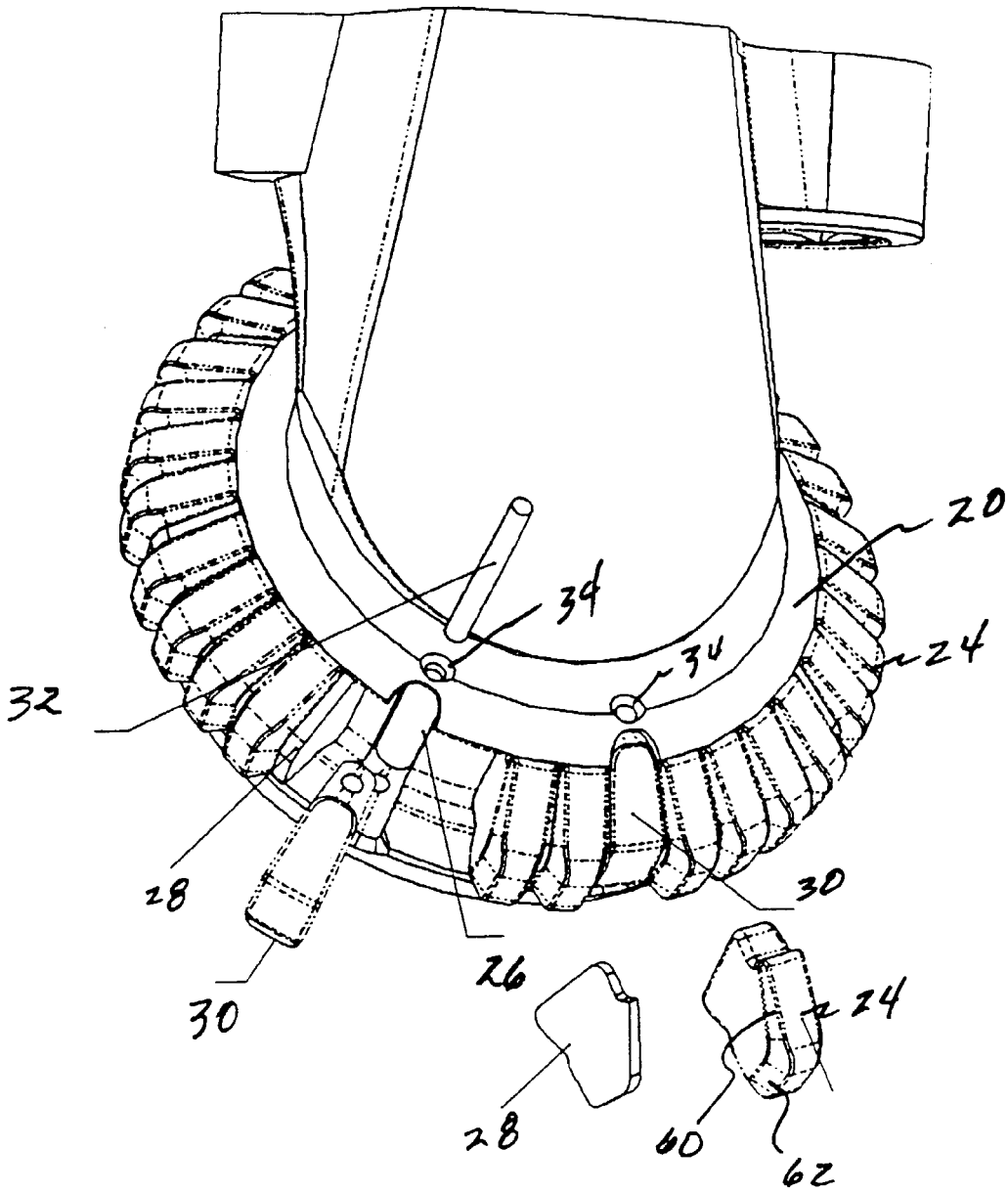
FIG. 2 is a perspective, partially exploded view of a bit constructed in accordance with the teachings of this invention.

The structure of the cone bit 16 will now be described with reference to FIGS. 2, 3A, 3B, 4A, and 4B. Other preferred embodiments of the cone bit will be described with reference to other drawing figures. The cone 16 comprises a cone body 20 of high alloy steel into which is machined or otherwise formed one or more circumferential channels or races 22, shown most clearly in FIG. 4B. The channels or races receive a plurality of cutter segments 24 which may vary in shape and contour according the particular earth formation into which the bit is to bore. The cutter or wear segments 24 are preferably tungsten carbide, although diamond enhanced cutters may be used, or other appropriate long lasting wear material. Each of the plurality of cutter segments 24 is placed into a keyway or slot 26 and slid into the channel 22. Two such keyways are shown in FIG. 2. The keyways of FIG. 2 may be referred to as "radial" keyways, because segments inserted into the keyways are inserted in a radial direction. It is to be understood that other configurations of keyways are possible within the scope and spirit of this invention. Each segment is then slid along the channel in turn, until the channel is substantially full of segments. Steel shims 28 may be used to insure a complete filling of the channel. Shims 28 of a given thickness may be placed between each segment to reduce the number of carbide segments being used. Thin steel shims may be used between each segment to prevent carbide against carbide breakage during the severe operating conditions experienced by rock bits. A final segment 30, in the nature of a key or locking wedge, then slid into the keyway and locked into place with a pin 32, for example, into a pin hole 34. Alternatively, the key 30 may be welded or otherwise secured in place. Also, the spaces in the channel and between the segments may be filled with silver solder or other suitable material, if desired. Silver solder may be used to bond the segments, key, and cone together as an additional safety factor to minimize the chances of leaving junk down hole in the case of cutting structure failure.

Figure 3B:
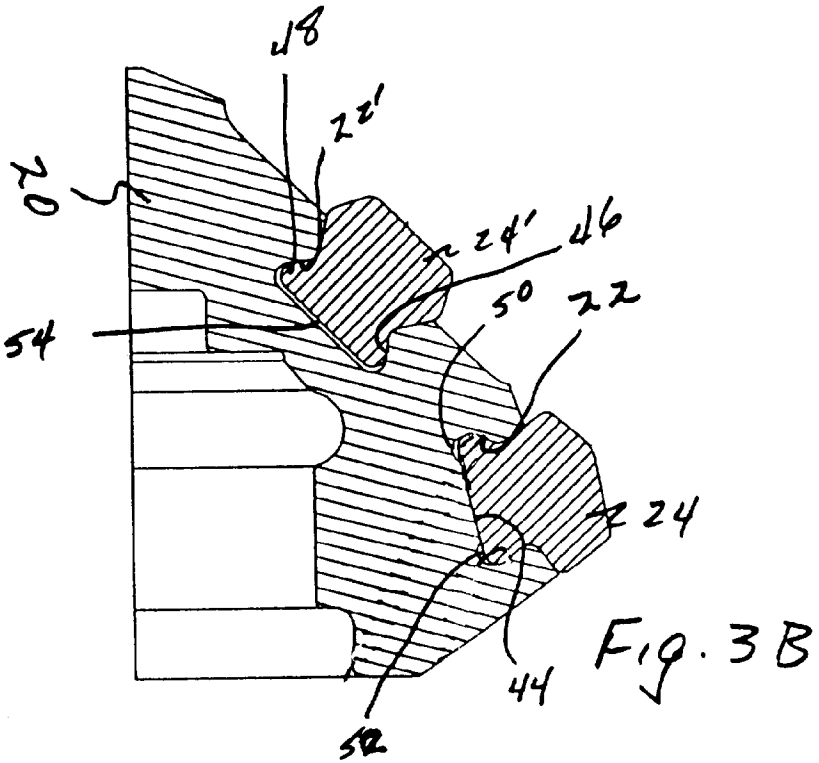
FIG. 3B is a section view of a cone body, depicting another preferred embodiment of locking segments into the race or channel.
Figure 3A:
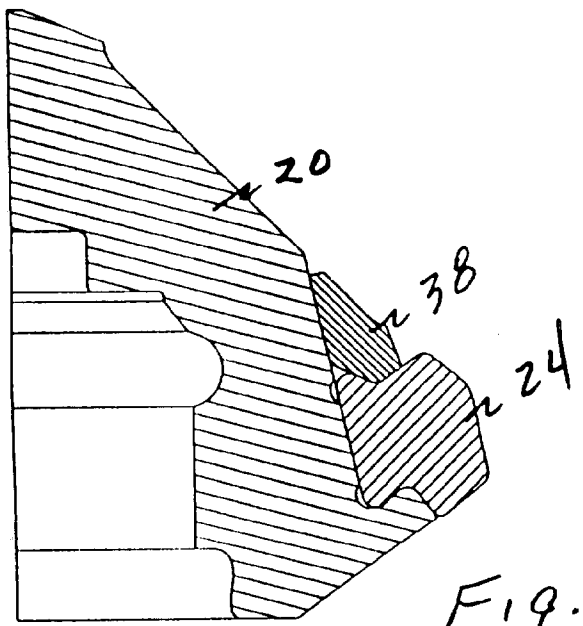
FIG. 3A is a section view of a cone body, depicting a preferred embodiment of locking segments into the race or channel.
Figure 4A:
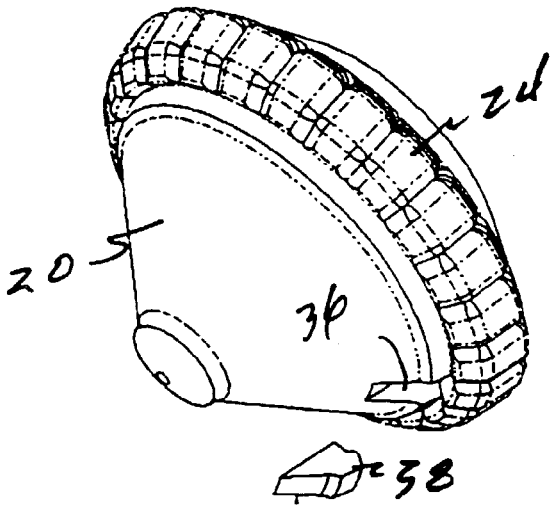
FIG. 4A is a perspective view of a cone body, illustrating details of locking segments into the race or channel.
Figure 4B:
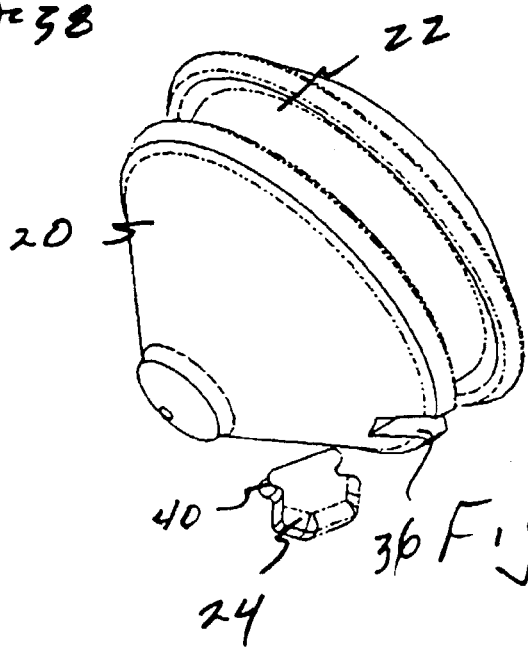
FIG. 4B is a perspective view of a cone body, illustrating details of inserting segments into the race or channel.

While the keyways of FIG. 2 were described as radial, FIGS. 3A, 4A, and 4B depict an "axial" keyway, in that the segments 24 are inserted into a slot 36 in an axial direction, and the slot 36 is cut axially into the cone body. After the last segment is inserted in place, a plug 38 is inserted behind the last segment, and preferably welded in place, thereby locking the segments in place. This embodiment of the invention provides the advantage in that the entire race or channel 22 is filled with segments, with no space allotted for the locking wedge 30, as in FIG. 2.

FIG. 3B depicts a section view of a portion of a cone body 20 with a section view of a wear segment 24 installed within the channel 22. Another segment 24 is shown within another channel 22', to illustrate another structure for supporting a segment, and also to illustrate a channel on the conical portion of the cone body. The channel 22 comprises a bottom surface 44 and side walls 46 and 48. Each of the side walls defines an "S" or ogee shape to provide a widened portion to receive a lobe 40 (FIG. 4B) of each segment 24. The segment 24 is subjected to a sideways force, resulting in torsion stress to the segment. This torsion stress may result in premature failure of the segment, so stress relieving annular grooves 50 and 52 are provided in the bottom 44 of the channel. In other words, the force on the wear segment 24 is transmitted to the cone through the bottom surface 44. Force on the lobes 40 could cause them to break, so relief grooves 50 and 52 are provided to eliminate that probability. An alternative to using surface 44 to transmit the load is to use the tapered side walls 46 and 48, as shown with regard to the segment 24' in the channel 22, including a gap 54 therebetween. This will also protect the retaining lobes 40 from being broken.

Figure 5:
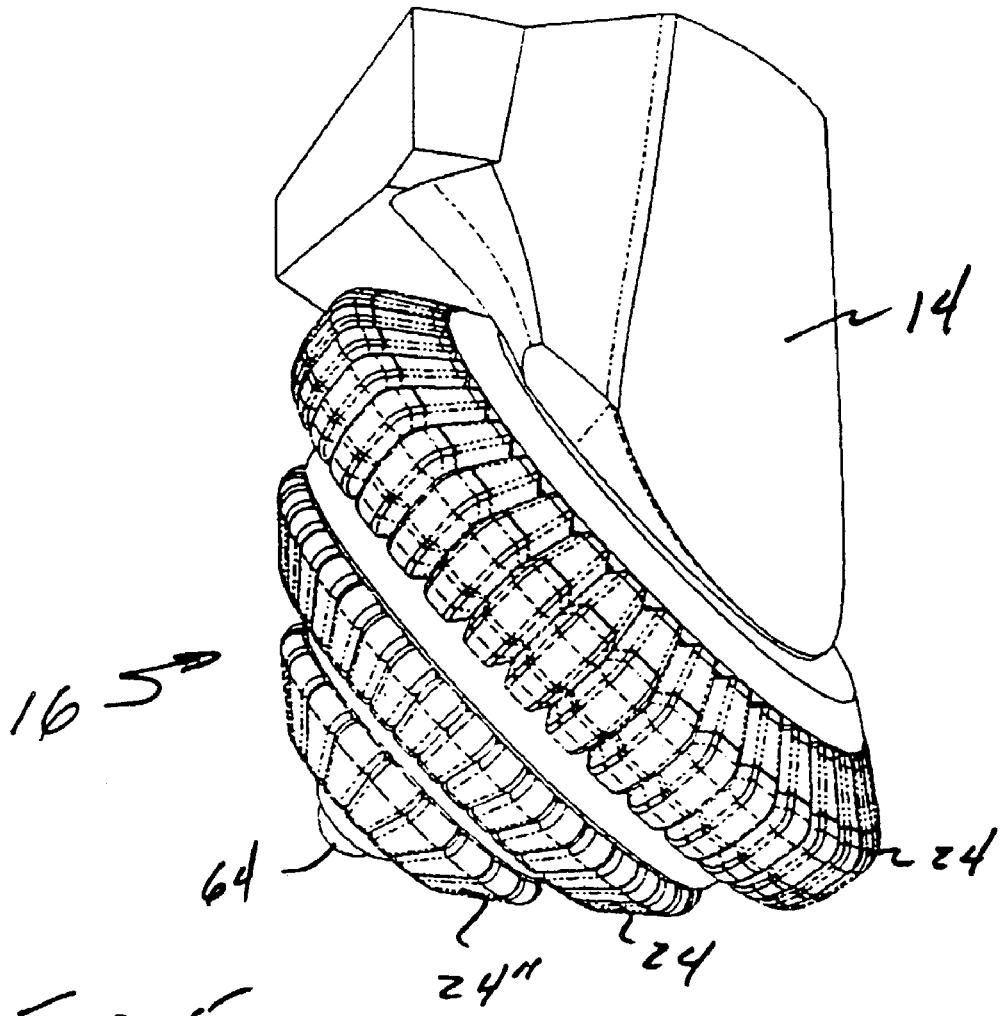
FIG. 5 is a perspective of a cone and supporting structure constructed in accordance with this invention.

FIG. 5 depicts a cutting structure designed with this invention for a very specific type of formation. The Bromide Sand in South Eastern Oklahoma is an example of this type formation. This very abrasive formation is drilled with a crushing and grinding action rather than with crushing, scraping, chipping and spalling actions like most other formations. Bits continue to drill Bromide Sand even after all the carbide is worn away. The bare steel of the cone continues to drill by crushing and grinding the formation. Therefore, sharp protruding points and ridges are not necessary on the segments 24 of the bit depicted in FIG. 5. Prior art bits used in Bromide Sand are plagued with short life due to early cutting structure wear, especially in the gage area. This invention was conceived to improve bit performance in the Bromide Sand drilling.

The bit of FIG. 5 includes a plurality of segments 24 installed in the gage row, and a plurality of interior row segments 24' and 24" along the conical portion of the bit. In this way, the greatest amount of wear resistant material, such as tungsten carbide, is presented to the abrasive wear area.

Returning briefly to FIG. 2, a gage row wear segment 24 is shown. The gage row wear segment 24 may preferably include an outside diameter beveled edge 60 and a bottom beveled edge 62. The beveled edges 60 and 62 are useful because the gage row segments are used as scrapers against the outside portion of the bore hole, while the interior row segments 24' and 24" are used to crush against the bottom of the bore hole, and thus the interior row segments 24' and 24" present a substantially flat aspect to the bore hole. The cone body 20 may also include a spherical insert 64 at the apex of the cone (FIG. 5).

Figure 6:
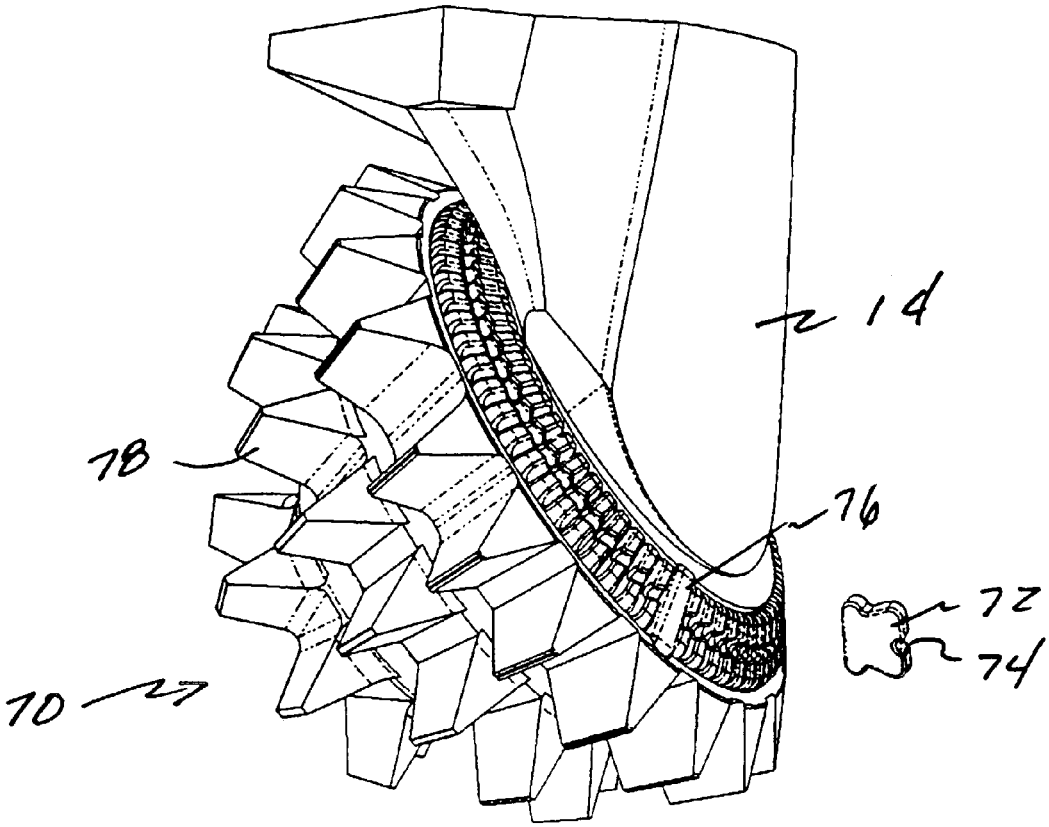
FIG. 6 is a perspective view of a roller cone of the invention with integral milled teeth on the cone body.

FIG. 6 depicts a presently preferred embodiment of the invention which the wear cutters or segments of this invention are installed on a milled tooth cutter 70. The milled tooth cutter 70, including a plurality of milled teeth 78, is formed in the conventional manner, and then a channel as previously shown and described is formed in the cone body. In this embodiment, a cutter or wear segment 72 includes a transverse groove 74 on the outer, exposed surface thereof. The gage row is completed with a wedge segment 76. The groove 74 allows crushed or sheared formation material to flow away from the points of contact where formation failure is actually taking place. This makes the crushing action more efficient. As the segments rotate away from contact with the formation, the detritus is washed from these grooves by fluid from the nozzles 18. The drilling mud or fluid picks up cuttings or crushed material removed from the borehole, and carries that material to be washed away by fluid from the nozzles.

Figure 7:
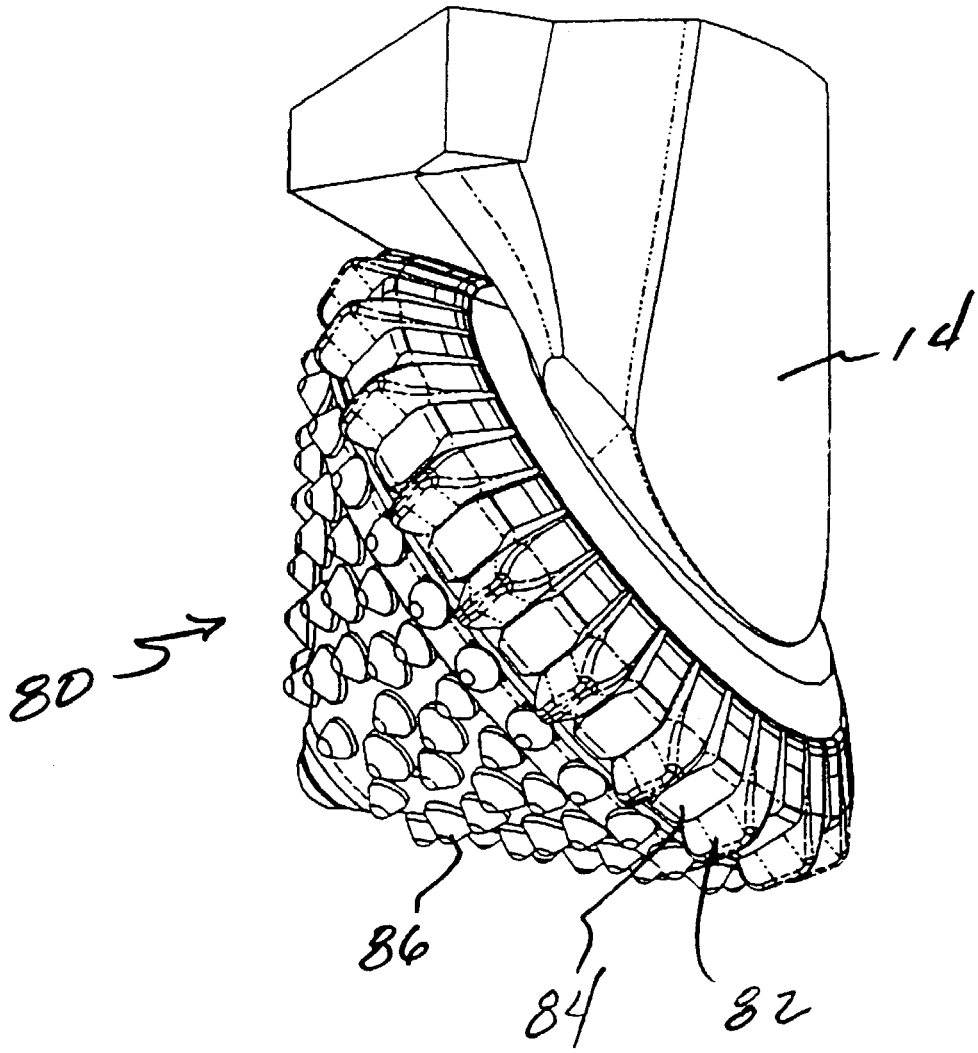
FIG. 7 is a perspective view of a roller cone with gage row wear segments in accordance with the invention, with inserts on the conical section of the bit.

FIG. 7 depicts another preferred embodiment of the invention, comprising a roller cone bit 80 with gage row segments 82 and 84, with inserts 86 on the conical portion of the bit 80. The segments 82 are sharper than those previously described, and form chisel segments for more aggressive cutting of the formation. The inserts 84 present a substantially flat aspect between the chisel segments 82. The insert 86 are made in the conventional manner, and are inserted into holes drilled or otherwise formed in the bit.

Figure 8:
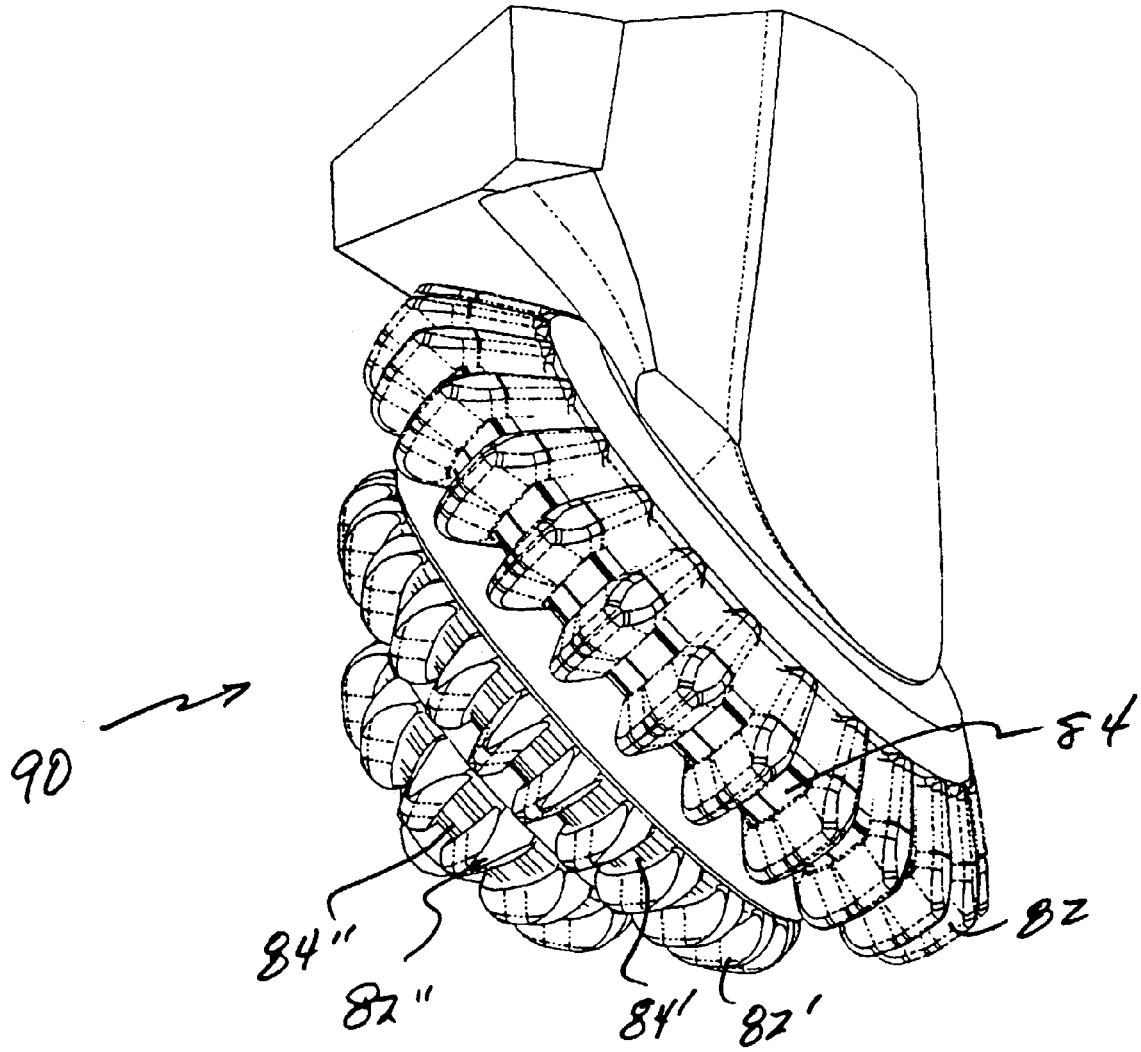
FIG. 8 is a perspective view of a roller cone with sharp wear segments on the gage row and interior rows.

Similarly, FIG. 8 shows a bit 90 with chisel segments 82 and substantially flat segments 84, as previously described. The bit 90 further includes chisel segments 82' and 82" on interior rows, with substantially flat segments 84' and 84" therebetween.

Figure 9:
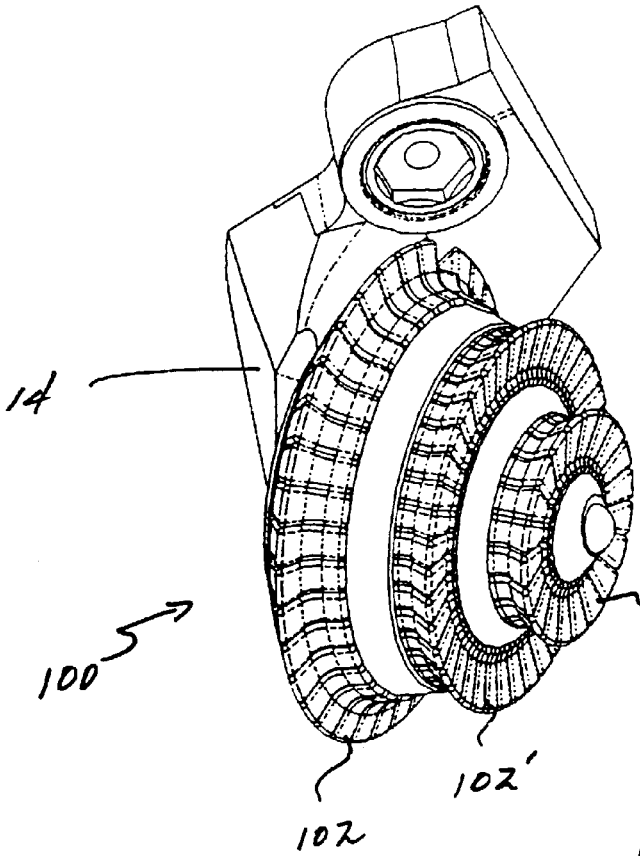
FIG. 9 is a perspective view of a disk cutter formed by inserting segments into channels in accordance with this invention.
Figure 10:
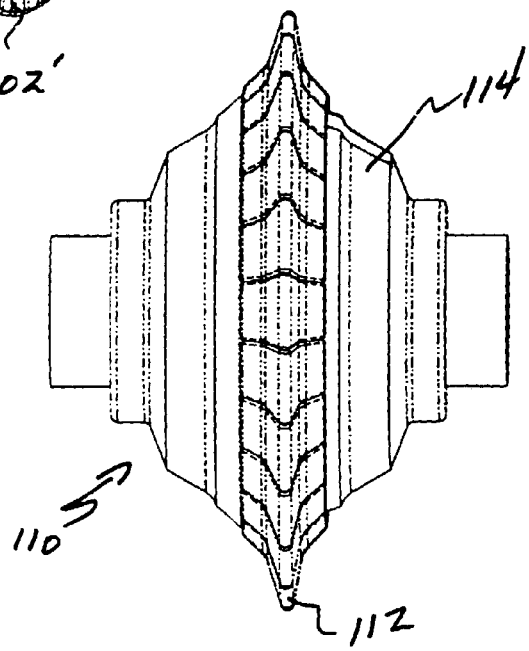
FIG. 10 is a side view of a tunnel boring disk cutter formed by inserting disk segments into channels in accordance with this invention.

FIG. 9 illustrates a disk cutter 100 constructed in accordance with the invention. The disk cutter 100 comprises a plurality of disk segments 102 is a gage row, and disk segments 102' and 102" in interior rows. The disk segments present a sharp substantially circular edge to the formation for aggressive cutting of the formation. Similarly, FIG. 10 shows a tunnel boring disk cutter 110 with segments 112 inserted into a channel formed in a disk cutter body 114. This structure provides the advantage of allowing virtually a solid ring of tungsten carbide, which allows the disk to have a sharper cutting radius and longer lifetime than previously known. These cutters cut faster and last longer than known disk cutters, permitting the tunneling machine to run with less down time.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A cone for a roller cone bit comprising:

a. a conical body;

b. a circular, annular channel in the conical body, the channel defining a bottom and opposing side walls, the opposing side walls being further apart adjacent the bottom than away from the bottom; and c. a plurality of cutter segments in the channel, the cutter segments in abutting contact with at least one of the cutter segments adjacent to it.

2. The cone of claim 1, further comprising at least one stress relieving annular groove in the channel bottom.

3. The cone of claim 1, wherein each of the plurality of cutter segments defines a pair of opposing lobes which mate in abutting engagement with the side walls of the channel.

4. The cone of claim 1, further comprising a slot in the body and into the channel to receive the plurality of cutter segments into the channel.

5. The cone of claim 4, further comprising a locking wedge in the slot.

6. The cone of claim 5, further comprising a pin through the body and through the locking wedge.

7. The cone of claim 1, wherein at least one of the plurality of cutter segments defines a beveled edge.

8. The cone of claim 1, wherein at least one of the plurality of cutter segments defines a transverse groove across the cutter segment.

9. The cone of claim 1, wherein the cutter body is a milled tooth cutter body.

10. A roller cone drill bit comprising:

a. a drill bit body having a threaded upper end for connection in a drill string;

b. the drill bit body extending below the threaded upper end in a downwardly deployed portion of the body;

c. a cone mounted for rotation on the downwardly deployed portion of the body, wherein the cone comprises:

i. a conical body;

ii. a circular, annular channel in the conical body, the channel defining a bottom and opposing side walls, the opposing side walls being further apart adjacent the bottom than away from the bottom; and iii. a plurality of cutter segments in the channel, the cutter segments in abutting contact with at least one of the cutter segments adjacent to it.

11. The bit of claim 10, further comprising at least one stress relieving annular groove in the channel bottom.

12. The bit of claim 10, wherein each of the plurality of cutter segments defines a pair of opposing lobes which mate in abutting engagement with the side walls of the channel.

13. The bit of claim 10, further comprising a slot in the body and into the channel to receive the plurality of cutter segments into the channel.

14. The bit of claim 13, further comprising a locking wedge in the slot.

15. The bit of claim 14, further comprising a pin through the body and through the locking wedge.

16. The bit of claim 10, wherein at least one of the plurality of cutter segments defines a beveled edge.

17. The bit of claim 10, wherein at least one of the plurality of cutter segments defines a transverse groove across the cutter segment.

18. The bit of claim 10, wherein the cutter body is a milled tooth cutter body.

19. A cone for a roller cone bit comprising:

a. a conical body;

b. circular, annular channels in the conical body, each of the channels defining a bottom and opposing side walls, the opposing side walls being further apart adjacent the bottom than away from the bottom; and c. cutter segments in the channels, the cutter segments in abutting contact with at least one of the cutter segments adjacent to it.

20. The cone of claim 19, wherein the body defines a periphery, and wherein a first of the circular, annular channels is positioned at the periphery.

21. The cone of claim 20, wherein a second of the circular, annular channels is positioned interior of the first of the circular, annular channels.

22. The cone of claim 20, wherein the first of circular, annular channels retains a set of gage cutter segments.

23. A tunnel boring disk cutter comprising:

a. a body;

b. a circular, unitary annular channel in the body, the channel defining a bottom and opposing side walls, the opposing side walls being further apart adjacent the bottom than away from the bottom; and c. a plurality of disk cutter segments in the channel, the cutter segments in abutting contact with at least one of the cutter segments adjacent to it; and d. a slot in the body and into the channel to receive the plurality of cutter segments into the channel.

* * * * *